US006835063B1

(12) United States Patent
Zimmer

(10) Patent No.: US 6,835,063 B1
(45) Date of Patent: Dec. 28, 2004

(54) LIGHTER

(76) Inventor: Horst Zimmer, Weidegasse 5, DE-54290, Trier (DE)

( * ) Notice: Subject to any disclaimer, the term of this patent is extended or adjusted under 35 U.S.C. 154(b) by 40 days.

(21) Appl. No.: 10/148,284

(22) PCT Filed: Nov. 9, 2000

(86) PCT No.: PCT/EP00/11070

§ 371 (c)(1),
(2), (4) Date: Oct. 7, 2002

(87) PCT Pub. No.: WO01/39617

PCT Pub. Date: Jun. 7, 2001

(30) Foreign Application Priority Data

Nov. 27, 1999 (DE) ..... 199 57 222

(51) Int. Cl.[7] ..... F23D 14/46
(52) U.S. Cl. ..... 431/253; 431/343
(58) Field of Search ..... 431/253, 343; 206/85, 36

(56) References Cited

U.S. PATENT DOCUMENTS 1,862,518 A * 6/1932 Alland ..... 206/259
2,782,910 A * 2/1957 Leibow ..... 206/87
3,057,180 A * 10/1962 Erwin ..... 431/202
3,921,948 A * 11/1975 Long ..... 248/220.41
4,223,784 A * 9/1980 Kaneyasu ..... 206/88

FOREIGN PATENT DOCUMENTS

| | | |
|---|---|---|
| AT | 241175 | 7/1965 |
| DE | G 84 27 004.7 | 1/1985 |
| WO | WO 97/05427 | 2/1997 |

* cited by examiner

*Primary Examiner*—Alfred Basichas
(74) *Attorney, Agent, or Firm*—Pauley Petersen & Erickson

(57) ABSTRACT

A lighter, in particular a gas lighter having a lighter body with a lighter head and a coupled fuel tank. At least two retaining elements are coupled to the lighter body. The lighter can be affixed to the outer side of the cigarette packet by the retaining elements which rest against mutually parallel side surfaces of the cigarette box. The lighter can be secured in a sufficiently reliable manner and an attractive visual appearance can be achieved by embodying the retaining elements as wire hoops, whereby at least one supporting segment of the retaining elements is located on the outer side of the assigned cigarette box.

12 Claims, 1 Drawing Sheet

LIGHTER

BACKGROUND OF THE INVENTION

1. Field of the Invention

This invention relates to a lighter, in particular a gas-operated lighter, having a lighter body with a lighter head and a connected fuel tank, wherein at least two fastening elements are connected to the lighter body, by which the lighter can be attached to the exterior of a cigarette pack, wherein the fastening elements rest against two lateral sides of the cigarette pack which extend parallel with each other.

2. Description of Related Art

A conventional lighter is known from German Patent Reference DE 84 27 004 U1. A holder is used for attaching the lighter to the cigarette pack. The holder has two legs, which are connected with each other via a connecting section. The connecting section divides two receiving areas between the two legs. The lighter can be maintained clamped between the legs in the one receiving area. The second receiving area is used for attachment to the cigarette pack. For this purpose the holder is pushed on the cigarette pack so that the connecting section contacts a narrow side of the cigarette pack. The two legs extend around the front, or rear side of the cigarette pack. The cigarette pack is deformed by the legs embodied as holding elements, and the two holding elements are simultaneously bent outward. The clamping force of the two holding elements cannot be so strong that the pulling of the holder off the cigarette pack is prevented. The large clamping forces required for this lead to the possible damage of individual cigarettes stored in the cigarette pack. If the cigarette pack is only partially filled with cigarettes, the cigarette pack does not provide a sufficiently large resistance to the holding elements, so that no clamping effect exists any more, particularly in connection with soft cigarette packs.

A lighter is described in PCT Reference WO97/05427, on whose fuel tank a holding element, embodied as a clip, is formed in one piece. The clip can be inserted into a cigarette pack so that one lateral wall of the cigarette pack is clampingly held between the clip and the fuel tank. The attachment of such a lighter on a cigarette pack is often difficult in those cases in which the cigarette pack is completely filled with cigarettes. It is necessary to push the cigarettes awkwardly to the side with the cigarette pack open, and the clip is then inserted.

A similar lighter is also known from Austrian Patent Reference AT 241 175. A clip, which is formed on a housing unit, is also used in this document. The housing unit has a receptacle, into which a throwaway lighter can be inserted.

SUMMARY OF THE INVENTION

It is one object of this invention to provide a lighter of the type mentioned above, which can be simply and securely placed on a cigarette pack and that has a visually pleasing structure.

This object is achieved with holding elements designed as wire hoops, each of which rests with at least one support section on the exterior of the associated cigarette pack. The wire hoops can be designed as visually inconspicuous elements, which lend the lighter a visual airiness. Moreover, the wire hoops can also be designed in such a way that the support sections can perform sufficiently large spring travels, so that a secure fixing in place of the cigarette pack is always provided.

In accordance with one embodiment, the lighter has a sliding surface arranged on the fuel tank, which is in contact with an exterior surface of the cigarette pack. The sliding surface transitions into support surface. The wire hoop has a leading runner in the transition area between the sliding surface and the support surface, which makes a transition into the support section. When the lighter is to be attached to the cigarette pack, it is initially placed with its sliding surface against the associated exterior surface of the cigarette pack. It is subsequently possible to displace the lighter in the direction of the long extension of this exterior surface. During this, the leading runners contact with the cigarette pack and are deflected on it in a spring-elastic manner. Accordingly, the leading runners are used as attachment aids and simplify the manipulation of the lighter.

In this connection, it is possible to provide a sliding surface that follows the support surface on both sides in the area facing the lighter head, as well as in the area facing away from the lighter head, and the wire hoops have leading runners in the area of these two sliding surfaces. With this embodiment the lighter can be selectively pushed on the cigarette pack over one or the other sliding surface.

In one embodiment of this invention, the wire hoops have a bow-shaped curved section which supports the support sections, and the support sections are facing each other and enclose a free distance between them, which is less than the width of the exterior of the cigarette pack used for attaching the lighter. In this case the wire hoops can be attached, inclined with respect to the lighter body.

It is also conceivable that the support sections are bent away from the bow-shaped curved section and extend behind the longitudinal edges formed between the exterior and the connected sides of the cigarette pack. The cigarette pack has a high degree of rigidity especially in the area of the longitudinal edges. The support sections now extend behind these longitudinal edges, because of which the sides connected with the longitudinal edges are slightly bent inward because of being acted upon by the support sections. The support sections also interlockingly extend behind the longitudinal edges and thus fix the lighter securely in place. The longitudinal edges can also form guide edges, along which the support sections of the lighter can be pushed, which has advantages in connection with the easy attachment of the lighter on the cigarette pack. The bow-shaped sections preferably rest against the support sections, as well as against the area of the partial sections following the support sections. The partial sections are arranged spaced apart from each other, so that a support length is created which makes possible the wobble-free clamping of the lighter.

The wire hoops are preferably injection-molded on the fuel tank, which is made of plastic. When manufacturing the fuel tank in an injection-molding machine, the wire hoops can also be placed into the injection mold. But it is also possible for the wire hoops to be a component of a fastening unit, which can be connected with the lighter.

BRIEF DESCRIPTION OF THE DRAWINGS

This invention is explained in greater detail in view of an exemplary embodiment represented in the drawing, wherein.

DESCRIPTION OF PREFERRED EMBODIMENTS

Figure 1:
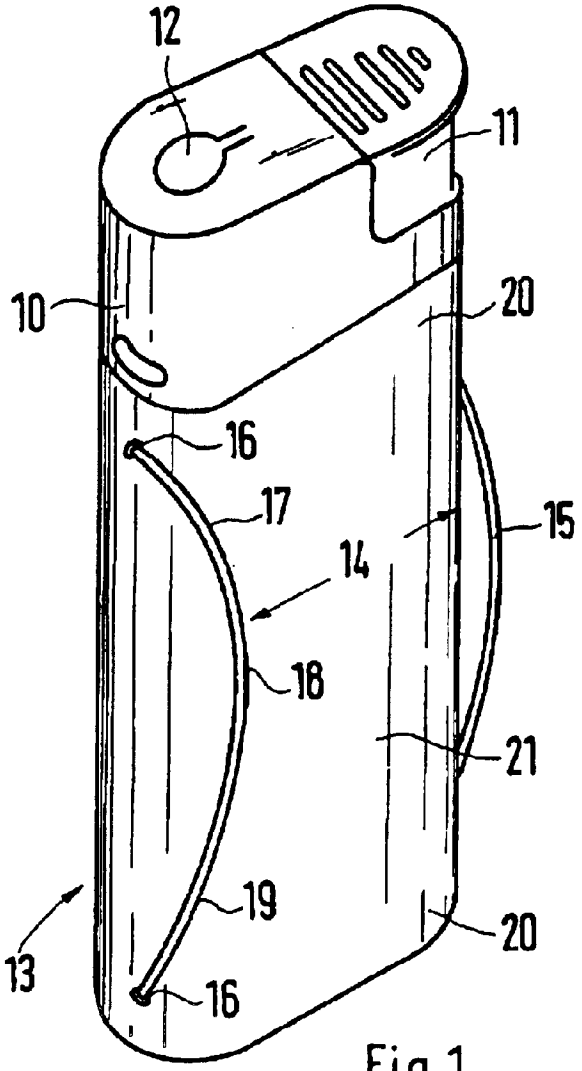
FIG. 1 shows a lighter in a perspective lateral view.

A lighter with a lighter body is represented in FIG. 1. The lighter body has a lighter head 10, to which a fuel tank 13 is connected. The lighter head 10 is designed in a conventional way with a push element 11 so that, when it is operated, a flame is created, which then emerges from a flame hole 12 of the lighter head 10. The fuel tank 13 can be designed as an injection-molded element, for example. It has two wide sides, which are connected with each other by rounded transition areas. Wire hoops 14 are connected in one piece with the fuel tank 13 in the transition areas. The wire hoops 14 have a curved, for example elliptical contour. This contour forms two leading runners 17 and 19, which are linked with a support section 18. End pieces are provided at the ends of the wire hoop 14, which are fixed in place on the fuel tank 13. In this way the wire hoops 14 can be produced in one production step together with the fuel tank 13. For this purpose the wire hoops 14 are inserted into the injection mold for the fuel tank 13. The wire hoops 14 are bent toward each other for forming the support sections 18. However, it is also conceivable that the wire hoops 14 are arranged on the fuel tank 13 in such a way that as a whole they are arranged inclined with respect to a wide side of the lighter body.

Figure 2:
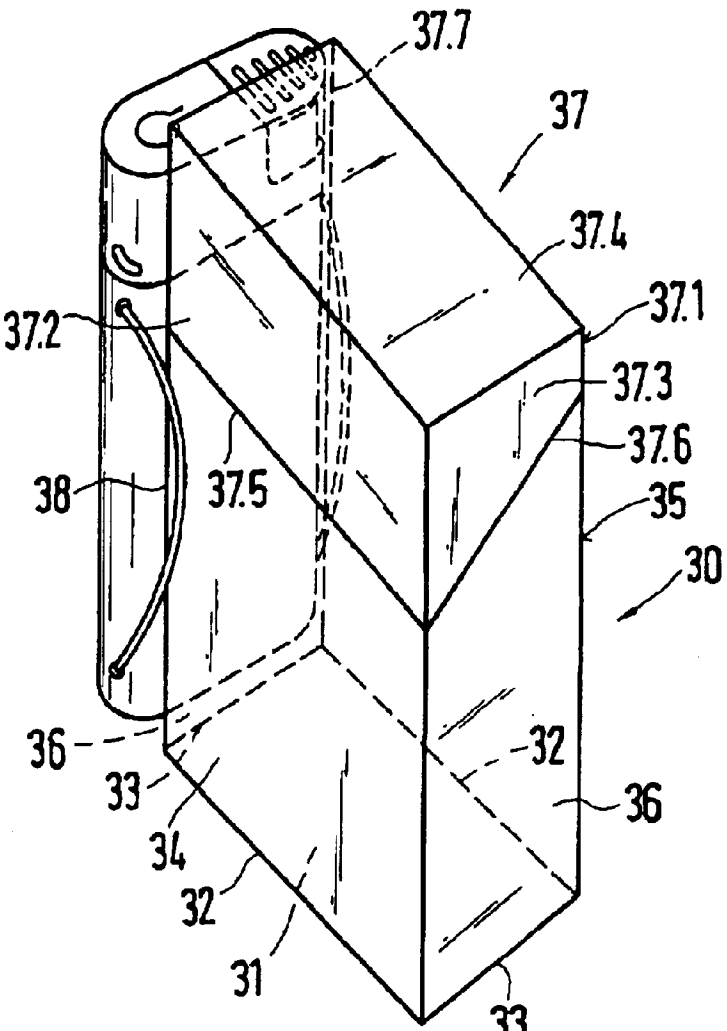
FIG. 2 shows a cigarette pack in a perspective view, to which the lighter illustrated in FIG. 1 is attached.

Together with a support surface 21, which is a part of the wide side of the fuel tank 13, the wire hoops 14 form a guide receiver. The support surface 21 transitions into sliding surfaces 20 extending on both sides of the guide receiver. One of the sliding surfaces 20 is also a partial surface of the wide side of the fuel tank 13. The other sliding surface 20 is assigned to the lighter head 10. The lighter represented in FIG. 1 can be attached to a commercially available cigarette pack, shown in detail in FIG. 2.

The cigarette pack 30 has a bottom 31, which is followed in the vertical direction by a front wall 34, a rear wall 35 and two lateral walls 36. Bottom edges 32 are arranged in the transition area between the bottom 31 and the vertically rising front wall 34 and the rear wall 35. Bottom edges 33 are created in the transition area between the bottom 31 and the lateral walls 36. A cover 37 is hinged to the rear wall 35 by a hinge wall 37.1. The cover 37 has a cover surface 37.4, which is followed by two vertical sides 37.3 and a front panel 37.1. The front panel 37.2 terminates in an edge 37.5 and makes a flush transition into the front wall 34 after this edge 37.5. In the area of the sides 37.3, the edge 37.5 makes a transition into edges embodied as beveled surfaces 37.6. Longitudinal edges 38, or 37.7, which extend in the longitudinal direction of the cigarette pack 30, are created in the transition area between the front wall 34, or the rear wall 35, and the lateral wall 36. For attaching the lighter, one of the sliding surfaces 20 is placed against a lateral wall 36 of the cigarette pack 30. In the following example it is possible to use the sliding face 20 of the lighter head 10. The lighter can subsequently be displaced in the longitudinal direction of the cigarette pack 30. During this the leading runners 17 encounter the bottom edges 32. Since the bottom edges 32 have a large amount of rigidity in the corner areas of the cigarette box 30, it is necessary to use some force for moving the leading runners 17 and 19 past the bottom edges 32. During this the wire hoops 14 spring resiliently outward. While sliding on the bottom edges 32, the cigarette pack comes into operational contact with the guide receiver, wherein for one the lateral wall 36 meets the support surface 21. In the course of the straight displacement of the lighter in relation to the cigarette pack 30, the support sections 18 of the wire hoops slide along the front wall 34, or the rear wall 35. The support sections 18 are at a free distance from each other which is less than the width of the lateral wall 36. Therefore the wire hoops 14 can extend behind the longitudinal edges 37.7, 38, and the support sections are slightly pushed into the front wall 34, or the rear wall 35. The front and rear walls 34 and 35 are slightly resiliently deformed, because of which they exert a spring force, which is directed against the support sections 18. This spring force prevents the lighter from being automatically displaced with respect to the cigarette pack 30. The displacement of the lighter in the direction toward the cover 37 is also hampered by the edge 37.5 of the front panel 37.2. In the opposite direction, the bottom edges 32 put up a resistance against the support sections 18.

The wire hoops 14 extend behind the longitudinal edges 37.7 and 38 with their support sections 18. The wire hoops 14 rest at two points on both sides of the support sections 18. This therefore results in a solid 3-point support, by which a wobble-free clamping of the lighter is possible. When pushing the lighter onto the cigarette pack 30, the wire hoops 14 must be sprung out for a sufficient displacement distance in order to be able to provide the required clamping force.

It becomes clear that the attachment of the lighter 30 can be easily accomplished because of the bow-shaped design of the wire hoops 14. In the area of their leading runners 17 and 19, the wire hoops 14 form a sort of insertion funnel, which makes the forced joining easier.

Visually the wire hoops 14 only appear as line-shaped elements, which has hardly any visual effect on the design of the lighter. Because the ends of the wire hoops 14 are fastened to the lighter body and otherwise have no angular protrusions, the lighter can be easily manipulated. It is possible in particular to introduce the lighter into a pocket, for example a breast pocket or a pants pocket, without snagging of the wire hoops 14.

What is claimed is:

1. In a lighter, such as a gas-operated lighter, having a lighter body with a lighter head and a connected fuel tank, wherein at least two fastening elements are connected to the lighter body for attaching the lighter to an exterior of a cigarette pack, wherein the fastening elements rest against two lateral sides of the cigarette pack which extend parallel with each other, the improvement comprising:

the holding elements formed as wire hoops (14), each resting with at least one support section (18) on the exterior of the cigarette pack, the lighter (10) having a sliding surface (20) arranged on the fuel tank (13) which contacts an exterior surface of the cigarette pack (30), the sliding surface (20) transitioning into a support surface (21), and the wire hoop (14) having a leading runner (17, 19) in a transition area between the sliding surface and the support surface, which transitions into the support section (18).

2. In the lighter in accordance with claim 1, wherein the sliding surface (20) follows the support surface (21) on both sides in a first area facing the lighter head (10) and in a second area facing away from the lighter head (10), and the wire hoops (14) have leading runners (17 and 19) near two sliding surfaces (20).

3. In the lighter in accordance with claim 2, wherein the wire hoops (14) each has a bow-shaped curved section which supports the at least one support section (18), and the at least one support section (18) face each other and enclose a free distance between them which is less than the width of the exterior of the cigarette pack (30) used for attaching the lighter.

4. In the lighter in accordance with claim 3, wherein the at least one support section (18) is bent away from the bow-shaped curved section and extends behind longitudinal edges (37, 7, 38) formed between the exterior surface and connected sides (34, 35) of the cigarette pack (30).

5. In the lighter in accordance with claim 4, wherein near an end, the wire hoop (14) is connected in one piece with the fuel tank (13).

6. In the lighter in accordance with claim 5, wherein the end of the wire hoop (14) is injection-molded into the fuel tank (13) made of plastic.

7. In the lighter in accordance with claim 6, wherein the wire hoop (14) is a part of a fastening unit which is connected with the lighter.

8. In the lighter in accordance with claim 1, wherein the wire hoop (14) is a part of a fastening unit which is connected with the lighter.

9. In a lighter, such as a gas-operated lighter, having a lighter body with a lighter head and a connected fuel tank, wherein at least two fastening elements are connected to the lighter body for attaching the lighter to an exterior of a cigarette pack, wherein the fastening elements rest against two lateral sides of the cigarette pack which extend parallel with each other, the improvement comprising:

the holding elements formed as wire hoops (14), each resting with at least one support section (18) on the exterior of the cigarette pack, the wire hoops (14) each having a bow-shaped curved section which supports the at least one support section (18), and the at least one support section (18) facing each other and enclosing a free distance between them which is less than a width of the exterior of the cigarette pack (30) used for attaching the lighter.

10. In the lighter in accordance with claim 9, wherein the at least one support section (18) is bent away from the bow-shaped curved section and extends behind longitudinal edges (37, 7, 38) formed between the exterior surface and connected sides (34, 35) of the cigarette pack (30).

11. In a lighter, such as a gas-operated lighter, having a lighter body with a lighter head and a connected fuel tank, wherein at least two fastening elements are connected to the lighter body for attaching the lighter to an exterior of a cigarette pack, wherein the fastening elements rest against two lateral sides of the cigarette pack which extend parallel with each other, the improvement comprising:

the holding elements formed as wire hoops (14), each resting with at least on support section (18) on the exterior of the cigarette pack, and near an end, the wire hoop (14) connected in one piece with the fuel tank (13).

12. In the lighter in accordance with claim 11, wherein the end of the wire hoop (14) is injection-molded into the fuel tank (13) made of plastic.

* * * * *